US010228094B2

(12) United States Patent
Cao et al.

(10) Patent No.: US 10,228,094 B2
(45) Date of Patent: Mar. 12, 2019

(54) LIGHTING DEVICE

(71) Applicant: Leedarson Lighting Co., Ltd., Zhangzhou, Fujian (CN)

(72) Inventors: Liangliang Cao, Fujian (CN); Xiaobo Chen, Fujian (CN)

(73) Assignee: LEEDARSON LIGHTING CO., LTD., Fujian (CN)

( * ) Notice: Subject to any disclaimer, the term of this patent is extended or adjusted under 35 U.S.C. 154(b) by 0 days.

(21) Appl. No.: 15/835,211

(22) Filed: Dec. 7, 2017

(65) Prior Publication Data

US 2019/0032857 A1 Jan. 31, 2019

(30) Foreign Application Priority Data

Jul. 29, 2017 (CN) ..... 2017 1 0634319

(51) Int. Cl.
*F21K 9/232* (2016.01)
*F21V 23/06* (2006.01)
*F21V 23/00* (2015.01)

(52) U.S. Cl.
CPC ..... *F21K 9/232* (2016.08); *F21V 23/003* (2013.01); *F21V 23/06* (2013.01)

(58) Field of Classification Search
CPC ..... F21K 9/232; F21V 19/003
See application file for complete search history.

(56) References Cited

U.S. PATENT DOCUMENTS

2016/0356461 A1* 12/2016 Lai ..... F21V 19/003
2016/0369949 A1* 12/2016 Wu ..... H05B 35/00
2018/0080611 A1* 3/2018 Haberkorn ..... F21K 9/232

FOREIGN PATENT DOCUMENTS

DE 102016117450 A1 * 3/2018 ..... F21K 9/238

OTHER PUBLICATIONS

Frye et al., DE 102016117450 A1, Sep. 16, 2016, English language machine translation.*

* cited by examiner

*Primary Examiner* — Daniel A Hess
(74) *Attorney, Agent, or Firm* — Chun-Ming Shih

(57) ABSTRACT

A lighting device includes a bulb shell, a base portion, a light bar module, a core stem, a lamp cap and a driving piece. The light bar module is composed of a plurality of light bars. Each light bar houses a plurality of LED chips. Electrical connectors are set at the two ends of each light bar respectively. The core stem extends upwardly from the base portion and has an expansion portion at the top. The electrical connector of light bars is fixed to the expansion portion. The open end of the lamp cap is connected to the bottom of the bulb shell. The driving piece is placed in the lamp cap. The lighting device achieves a technical effect in which the lighting effect is uniform and the lighting angle is large.

13 Claims, 11 Drawing Sheets

LIGHTING DEVICE

FIELD OF THE INVENTION

The present invention is related to a lighting device, and more particularly related to a light emitting diode (LED) lighting device.

BACKGROUND OF THE INVENTION

As the development of the LED technology in recent years, the light industry has changed a lot. More and more LEDs have been applied to lighting devices, especially to bulb lights. However, the LED light can't light-round as the incandescent lamp; the light emitted from LEDs has strong directivity. The lighting device with LED light bulbs always light uneven, and it is easy to generate a dark spot at a portion of one end of the bulb due to less light. What's more, because of the strong directivity, the LED bulb lighting device always light with small angle, which can't meet the lighting requirements.

Therefore, how to design a LED lighting device with uniform lighting effect and big lighting angle is the most urgent technical problem to be solved.

SUMMARY OF THE INVENTION

The first embodiment of the present invention provides a lighting device. The lighting device includes a bulb shell, a base portion, a light bar module, a core stem, a lamp cap and a driving piece. The base portion is connected to the bulb shell to form a containing space. The base portion has a closed air inlet. The lighting device further includes inert gases. The inert gases are filled in the containing space through the air inlet while manufacturing, and maintained within the containing space after the air inlet is closed. On one hand these inert gases can prevent the metal parts in the containing space from oxidation, on the other hand it can increase the heat transfer efficiency of the light bar module.

The light bar module is placed in the containing space. The light bar module is composed of a plurality of light bars, and each light bar houses a plurality of LED chips. There is an electrical connector at the two ends of each light bar, respectively. The main lighting direction of each of the plurality of light bars is not exactly the same, for example, by setting the light bars at different angles to make the main lighting directions of these light bars oriented in different directions. Usually, the lighting angle of the LED chips is about 120 degrees, which is the light concentrated range. If the base portion is made of transparent material, such as glass, there is also a 120 degrees main light concentrated range on the back. By adjusting the main lighting direction of these light bars, can reduce the dark area appeared on the bulb shell.

For example, if the bulb shell is non-transparent, such as matte, the dark area may make the overall light effect of the bulb fail to meet expectations.

In addition, the core stem extends upwardly from the base portion. The core stem is further provided with an expansion portion at the top, and the electrical connector of one end of the plurality of light bars is fixed to the expansion portion. The open end of the lamp cap is connected to the bottom of the bulb shell.

The driving piece is placed in the lamp cap. The driving piece is electrically connected to the light bar module to provide electric power required for the plurality of light bars to illuminate.

In one embodiment, the core stem is made of metal, which means the entire core stem is made of metal, or part of core stem is made of metal, part of that is made of nonmetal. For example, the body of the core stem is made of glass, embedded with metal wire, metal sheet, etc. The electrical connector of one end of the light bar can be electrically connected through the metal part of the core stem. One way is all electrical connectors of the light bars are electrically connected through the metal part of the core stem. Another way is some light bars are indirectly secured to the core stem by an insulating object, such as a non-conductive adhesive or a non-conductive gasket. Or there are a plurality of isolated metal parts on the core stem, the plurality of light bars are divided into two or more groups, each group is electrically connected through the metal parts of the core stem, while at the same time, the light bars in different groups are electrically connected to each other but not through the metal portion of the chip.

In another embodiment, the core stem is made of glass. The expansion portion and the core stem are made of different materials, for example, the expansion portion is made of metal conductive material, and the expansion portion is installed on the top of the core stem to provide a peripheral structure with a horizontally unfolded distance larger than the diameter of the core stem. In other words, if the core stem is a cylindrical or polygonal column, there is a horizontal cross-sectional area of the core stem along the horizontal cross-section. On the other hand, there is a horizontal cross-sectional area of the expansion portion in a direction parallel to the horizontal section, and the horizontal cross-sectional area of the expansion portion is larger than the horizontal sectional area of the core stem. The expansion portion may be sleeved to the top of the core stem like wearing a hat, or fixed to the top or relative upper portion of the core stem by other structures. For example, sleeve a collar to the top of the core stem or an upper groove, or gluing to help strengthen the fixing or heat dissipation.

In addition, a conductive passage may be set in the expansion portion for connecting the electrical connector of one end of the plurality of light bars and directing the current to the driving piece.

The core stem and the expansion portion can be made of same material or different material. It can be designed according to different design requirements In another embodiment, the core stem is made of metal, similar to the above description, the horizontal cross-sectional area of the expansion portion is larger than the horizontal sectional area of the core stem. In addition, the expansion portion is formed by bending the top of the core stem and constituted a peripheral structure with a horizontally unfolded distance larger than the diameter of the core stem.

In an embodiment, the electrical connectors of the plurality of light bars are connected to the expansion portion. In an embodiment, the core stem is a metal strip, and bending the top of that to form a horizontal circular structure, as the expansion portion.

In another embodiment, the core stem could be a metal strip, and bending the top of that to form a horizontal polygon structure, as the expansion portion.

Absolutely, the metal strip may also be wound into a variety of planar or three-dimensional expansion portions of different shapes for connecting one end of the plurality of light bars.

In an embodiment, the base portion is made of glass. The bottom of the core stem is embedded in the base portion, by the tight coupling between the base portion and the core stem to transmit the light, emitted by the plurality of light bars, to the base portion effectively, and further transmit it to the bulb shell. As the bulb shell is provided with a large heat dissipation area, the heat can be satisfactorily dissipated into the outside. For example, the glass base portion may be softened or melted by heating so as to insert the bottom of the core stem into the base portion. Another approach is to place the core stem and the associated wire directly into the heat-resistant mold, then pour the molten glass so that the cooled base portion directly covers the core stem.

According to another embodiment, the lighting device may further include a plurality of extension pieces extending outwardly from the base portion and the electrical connectors of the other ends of the plurality of light bars are electrically connected to the extension pieces, respectively.

The electrical connectors of one end or the other end of the light bar is a conductor, which can be used to electrically connect with an external circuit element or power line in series to direct the appropriate current to the LED chips of the light bar, making the LED chips emit light. The electrical connector of each light bar can be set independently, but also can be integrated formed with an electrical connector of another light bar. In other words, in the latter case, if you want to connect the two light bars in series, additional welding is not needed, as at least one end of the two lights have been connected in series.

According to an embodiment, one end of the plurality of light bars forms a top polygon, and the other end of the plurality of light bars forms a bottom polygon, and the area of the top polygon is smaller than the area of the bottom polygon. In other words, one end of the plurality of light bars has a relatively small polygon, and the other end of the plurality of light bars has a relatively large polygon, both of that form a substantially polygonal cone with a wide bottom and a narrow top. This setting can offer a relatively desired lighting route.

In addition, according to another embodiment, the shape of the top polygon is substantially similar to the shape of the bottom polygonal, but is shifted by a predetermined angle. As described above, these light bars usually have different lighting directions. If these light bars are directly perpendicular to the surface of the bulb shell, it is easy to produce a partial area which is particularly bright and a partial area which is relatively dark, thereby generating light spots. Also, such a problem is particularly noticeable when the bulb shell is not completely transparent, such as the bulb shell is milky white. It has been experimentally found that if the top polygon of the plurality of light bars is shifted from the bottom polygon by an angle, a more desirable lighting effect can be obtained, for example, avoiding the light spots. In addition, the ideal shifted angle can be greater than 10 degrees, less than 80 degrees.

As described above, for the light spot problem, it is possible to make the regular light spot disappear by adjusting the main lighting direction of the plurality of light bars. Because of the different shape and size of the bulb shell, the length of the light bar and the lighting angle might not the same. Hence, the best shifted angle can be ensured by white painting, and experimentally adjusting the main lighting direction of the plurality of light bars, to reduce the dark zone formed on the shell because of less light.

In another embodiment, the core stem can assist in the electrical connection directly or indirectly. In the application of LED chips, there will be a positive and a negative power input terminal. Thus, the core stem can provide a first electrode contact in this embodiment, such as the positive or negative power input terminal. On the other hand, the plurality of extension pieces may provide a second electrode contact, that is, another power input terminal in a different direction from the core stem. The electric power required for the plurality of light bars to light can be supplied by the core stem and the extension piece, and the associated wiring circuit.

In some embodiments, these light bars can be provided in series/parallel. Of course, the description here, in addition to the first group of light bars, a second set of light bars also can be allowed, and different designs can be designed base on different needs. For example, for the light bars with different directions, it can be arranged in different groups with relatively different parameters, to provide different lighting parameters, so that to produce the most effective lighting effects on the entire lighting device.

In addition, if the angle of the light bar can be further homogenized, that is, not only light at a specific angle, and the lighting effect of the entire lighting device would be better, and at the same time, by such setting, the lighting angle of the device will be greatly increased. One approach is setting the light bars with more three-dimensional way. As described in the previously embodiments, the bottom cross-section of the translucent cover needs often to match with the size of the lamp cap. On the other hand, if the light bar module need be placed in the translucent cover, as it is often limited by the bottom cross-section of the translucent cover, so it is not easy to put it into the transparent cover.

Thus, in one embodiment, some elastic elements can be added to the extension piece of the base portion, such as a shrapnel or spring, to make a certain compression to the bottom of the light bar module when placing the light bar module and base portion together into the bulb shell from the bottom of the bulb shell, after it is placed, and then expand the bottom of the light bar module.

With this design, the polygonal area at the bottom of the light bar module can be larger than the inlet area of the lamp cap. And, this design can make the lighting angle of the entire light bar module more three-dimensional, but also can bring better lighting effect.

In addition, even with the same number of LED chips, a relatively longer light bar can further uniform the light. In one embodiment, the height of the plurality of light bars in the direction of the lamp cap axis accounts for more than 50% of the height of the light bulb shell in the same direction, so that a better lighting effect can be produced.

In addition, dark areas often appear at the top of the lighting device such as bulbs. In order to solve such a problem, it is possible to place a denser LED chips in a region that the light bar near the top of the translucent cover, i.e., the light bar away from the bottom of the light translucent cover. Alternatively, one or more light sources may be installed on the expansion portion. For example, the expansion portion can be made into a module in which a substrate with LED chips and an optical element are provided, the optical element can handle light more uniform, such as a diffuser plate. By mounting a light source on the expansion portion, the lighting strength toward the top of the light bulb shell can be enhanced.

In addition, in some embodiments, it is also possible to further provide a reflective surface corresponding to the plurality of light bars on the core stem, to reflect the light from the plurality of light bars to the core stem. In the design of the lighting device, guiding the light to the desired area, it is not only useful for improving the optical effect, but also useful for avoiding unnecessary hot spots concentration, which would easily result in components aging.

As mentioned above, the light bar module is mainly located above the base portion. In order to supply power, the driving piece under the base portion also needs to generate the required current. For the convenience of assembly, two electrical connecting wires may be led from the bottom of the base portion, and on the other hand, two corresponding electrical connectors may be provided at the top of the driving piece, such as the driving circuit board. When assembling, the two electrical connecting wires can be inserted into the two electrical connectors, eliminating time and cost of soldering. In another embodiment, the base portion may be provided with a protruding electrical connector, and the driving piece may be provided with an interface, or another different design.

In addition, in order to provide heat dissipation, it is also possible to provide a heat sink with various shapes connected with the core stem on the base portion. These heat sinks can be further connected to other heat sinks, such as the heat sinks inside the driving piece or lamp cap, or connected to the bulb shell to enhance the heat dissipation effect. All of which should to be considered as falling within the scope of the present invention.

The other embodiment of the present invention provides a method of fabricating a lighting device. The method of fabricating a lighting device includes the following steps.

First, provide a base portion. For example, shape materials with the mold, the materials could be glass or plastic materials, etc.

Set a core stem on the base portion, and provide the expansion portion on the top of the core stem. Both of the core stem and the base portion can be made of glass. The core stem and the base portion may be made of different materials, such as the core stem is made of metal rod, metal strip, an iron-nickel wire, and the like, while the base portion is made of glass.

Set the plurality of light bars to the core stem, wherein an electrical connector of one end of the plurality of light bars is fixed to the expansion portion. In other words, more than two one end of the light bars are connected to the expansion portion. However, this does not mean that a lighting device can only have a group of light bars. In other words, it is not necessary that all the light bars must have one end connected to the expansion portion.

Provide a plurality of extension pieces on the other end of the plurality of light bars, the extension pieces extending outwardly from the base portion. These extension pieces may be metal rods, metal strips, iron-nickel wire and other materials. These extension pieces may be embedded in the base portion with a variety of different processes. Of course, the base portion mentioned here also includes the bottom of the core stem.

Fix the plurality of extension pieces to the electrical connectors of the other end of the plurality of light bars, respectively. One of the simplest connections is that the first electrical connector at one end of all the light bars is connected to the positive terminal and the second electrical connector at the other end of all the light bars is connected to the negative terminal. In other words, all light bars are supplied in parallel. Of course, the present invention is not limited to this type of connection, but may be the other electrical connections.

Install the bulb shell to make the bottom of the bulb shell connect with the base portion to form a containing space. Fill an inert gas into the containing space from the air inlet of the base portion. And after completion of the inflation, the air inlet may be sintered to form a closed containing space so that the inert gas remained in the containing space.

The beneficial effect of the present invention is: by the above-described technical solution, it is possible to light uniform with large lighting angle for the LED bulb lighting device.

DETAILED DESCRIPTION

Figure 1:
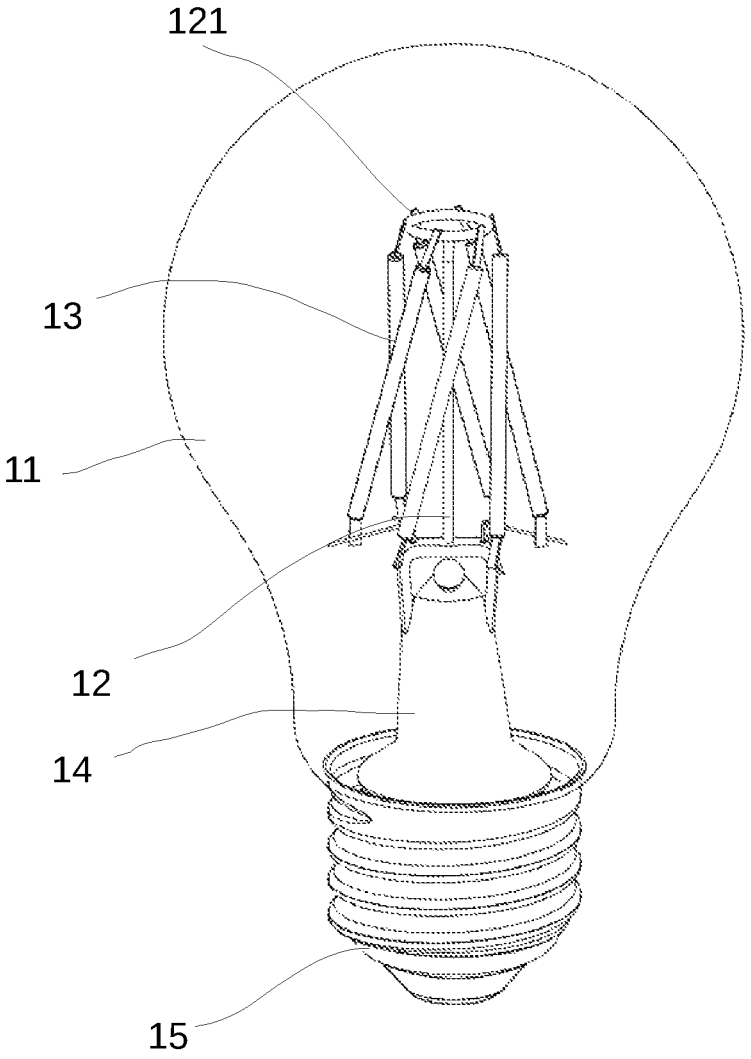
FIG. 1 illustrates an example of a lighting device.
Figure 2:
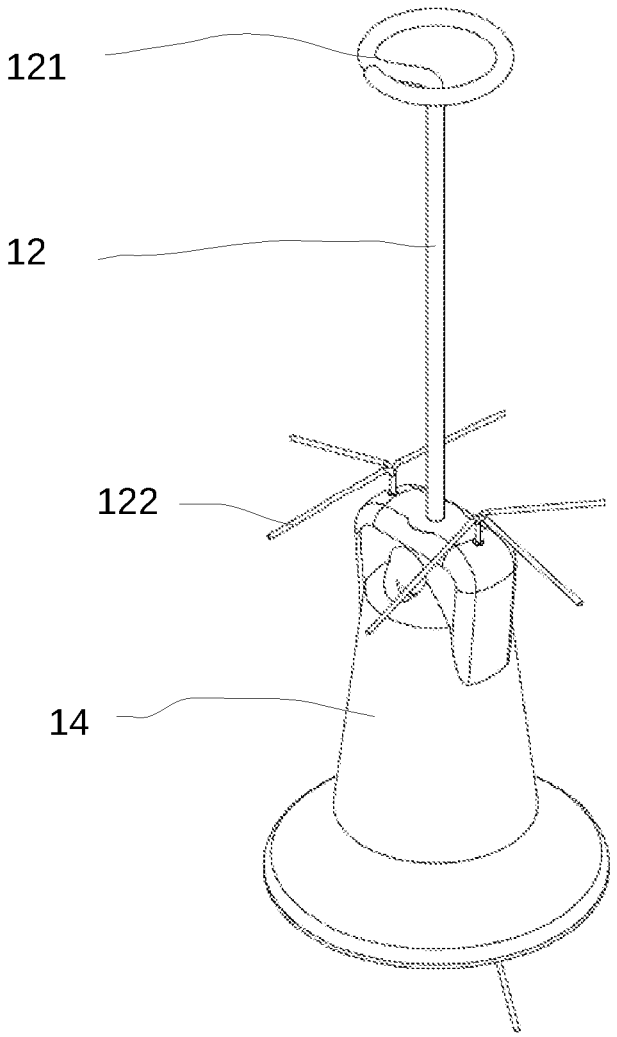
FIG. 2 illustrates an enlarged view of partial elements of FIG. 1
Figure 3:
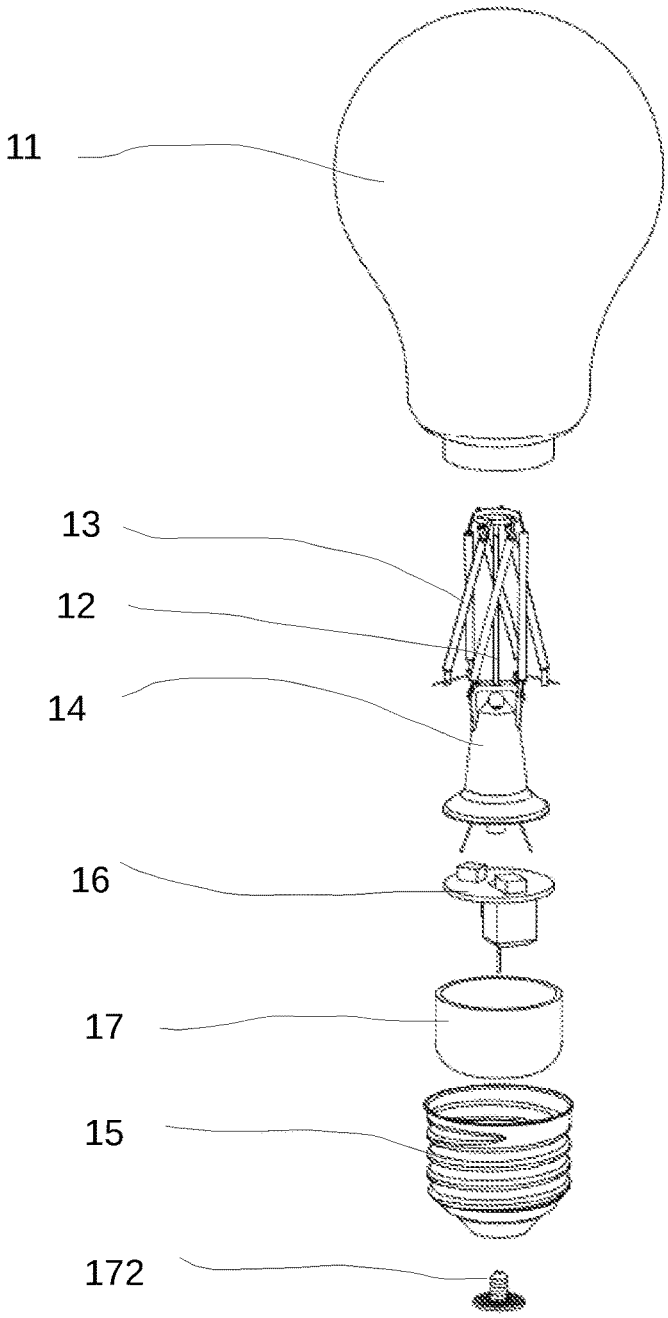
FIG. 3 illustrates an exploded view of a lighting device

Please refer to FIG. 1 to FIG. 3. FIG. 1 to FIG. 3 illustrate an example of a lighting device according to present invention. FIG. 1 illustrates an example of a lighting device. FIG. 2 illustrates an enlarged view of partial elements of FIG. 1. FIG. 3 illustrates an exploded view of a lighting device.

The lighting device includes a bulb shell 11, a base portion 14, a light bar module 13, a core stem 12, a lamp cap 15 and a driving piece 16. The base portion 14 is connected to the bottom of the bulb shell 11 to form a containing space. The base portion 14 has a closed air inlet. The lighting device further includes inert gases. The inert gases are filled in the containing space through the air inlet and maintained within the containing space after the air inlet is closed. On one hand the inert gases can prevent the metal parts in the containing space from oxidation, on the other hand it can increase the heat transfer efficiency.

The light bar module 13 is placed in the containing space. The light bar module 13 is composed of a plurality of light bars, each light bar houses a plurality of LED chips, and there is an electrical connector at the two ends of each light bar, respectively. The main lighting direction of each of the plurality of light bars is not exactly the same, for example, by setting the light bars at different angles to make the main lighting directions of these light bars oriented in different directions. Usually, the lighting angle of the LED chip is about 120 degrees, which is the light concentrated range. If the base portion is made of transparent material, such as glass, there is also a 120 degrees main light concentrated range on the back. By adjusting the main lighting direction of these light bars, can reduce the dark area appeared on the bulb shell.

Please refer to FIG. 2 and FIG. 3. The core stem 12 extends upwardly from the base portion 14. The core stem is further provided with an expansion portion 121 at the top, and the electrical connector of the one end of the plurality of light bars is fixed to the expansion portion 121. The open end of the lamp cap 15 is connected to the bottom of the bulb shell. In order to insulate most of the electronic components in the driving piece 16 from the lamp cap 15, an insulating cup 17 may also be placed, and the driving piece 16 is placed in the insulating cup 17 during assembly.

The insulating cup 17 is placed in the lamp cap 15, and the driving piece 16 is electrically connected to the light bar module 13 to provide the electric power required for the plurality of light bars to light.

In an embodiment, the core stem 12 is made of glass. The expansion portion 121 and the core stem 12 are made of different materials, for example, the expansion portion 121 is made of metal conductive material, and the expansion portion 121 is installed on the top of the core stem 12 to provide a peripheral structure with a horizontally unfolded distance larger than the diameter of the core stem. In other words, if the core stem 12 is a cylindrical or polygonal column, there is a horizontal cross-sectional area of the core stem along the horizontal cross-section. On the other hand, there is a horizontal cross-sectional area of the expansion portion in a direction parallel to the horizontal section, and the horizontal cross-sectional area of the expansion portion 121 is larger than the horizontal sectional area of the core stem. The expansion portion 121 may be sleeved to the top of the core stem like wearing a hat, or fixed to the top or relative upper portion of the core stem by other structures. For example, sleeve a collar to the top of the core stem or an upper groove, or gluing to help strengthen the fixing or heat dissipation.

In addition, a conductive passage may be provided inside the expansion portion 121 for connecting the electrical connector of one end of the plurality of light bars and directing the current to the driving piece 16.

The core stem 12 and the expansion portion 121 can be made of same material, or different material. It can be designed according to different design requirements In another embodiment, the core stem 12 is made of metal, similar to the above description, the horizontal cross-sectional area of the expansion portion 121 is larger than the horizontal sectional area of the core stem 12. In addition, the expansion portion 121 is formed by bending the top of the core stem and constituted a peripheral structure with a horizontally unfolded distance larger than the diameter of the core stem.

In an embodiment, the electrical connectors of the plurality of light bars are connected to the expansion portion 121. In an embodiment, the core stem 12 is a metal strip, and bending the top of that to form a horizontal circular structure, as the expansion portion 121.

In addition, the height 1502 of the plurality of light bars in the direction of the lamp cap axis accounts for more than 50% of the height 1501 of the light bulb shell in the same direction, so that a better lighting effect can be produced.

Figure 4:
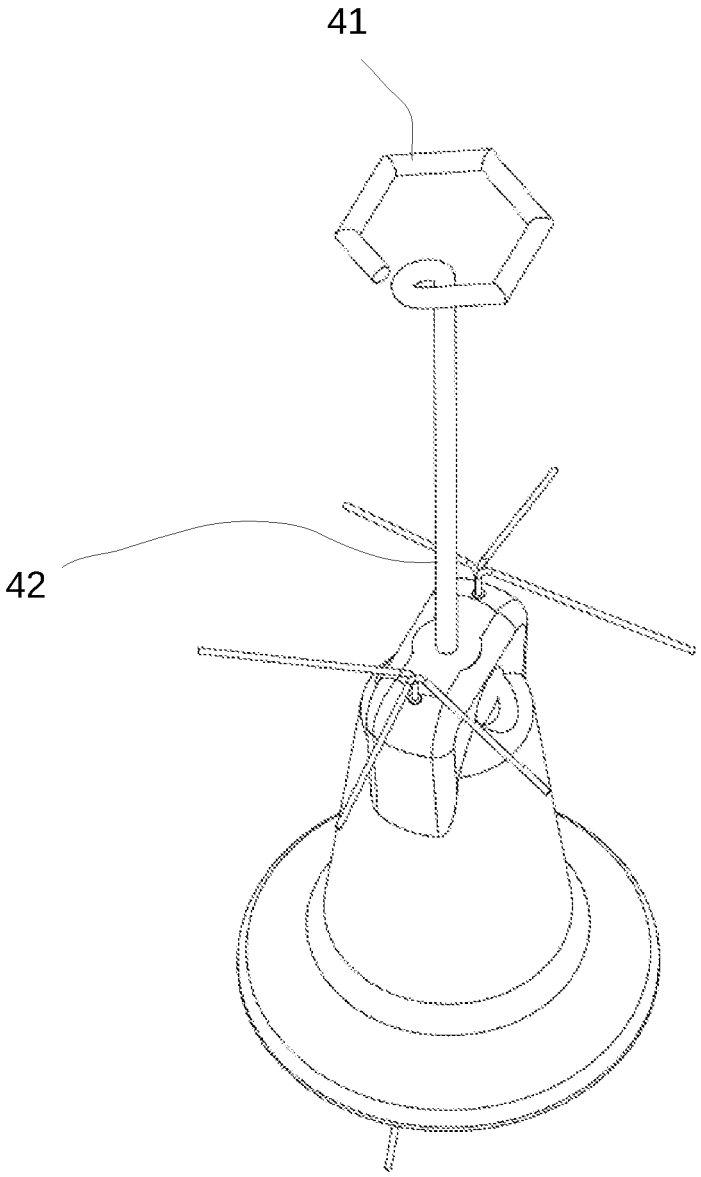
FIG. 4 illustrates another embodiment of a lighting device.

Please refer to FIG. 4. FIG. 4 illustrates another embodiment of the expansion portion. The core stem 42 could be a metal strip, and bending the top of that to form a horizontal polygon structure 41, as the expansion portion.

Absolutely, the metal strip may also be wound into a variety of planar or three-dimensional expansion portions of different shapes for connecting one end of the plurality of light bars.

In an embodiment, the base portion is made of glass. The bottom of the core stem is embedded in the base portion, by the tight coupling between the base portion and the core stem to transmit the light, emitted by the plurality of light bars, to the base portion effectively, and further transmit it to the bulb shell. As the bulb shell is provided with a large heat dissipation area, the heat can be satisfactorily dissipated into the outside. For example, the glass base portion may be softened or melted by heating so as to insert the bottom of the core stem into the base portion. Another approach is to place the core stem and the associated wire directly into the heat-resistant mold, then pour the molten glass so that the cooled base portion directly covers the core stem.

Please refer to FIG. 2. According to another embodiment, the lighting device may further include a plurality of extension pieces 122 extending outwardly from the base portion 14 and the electrical connectors of the other ends of the plurality of light bars are electrically connected to the extension pieces 122, respectively.

The electrical connectors of one end or the other end of the light bar mentioned here are conductors, which can be used to electrically connect with an external circuit element or power line in series to direct the appropriate current to the LED chips of the light bar, making the LED chips emit light. The electrical connector of each light bar can be set independently, but also can be integrated formed with an electrical connector of another light bar. In other words, in the latter case, if you want to connect the two light bars in series, additional welding is not needed, as at least one end of the two lights have been connected in series.

Figure 5:
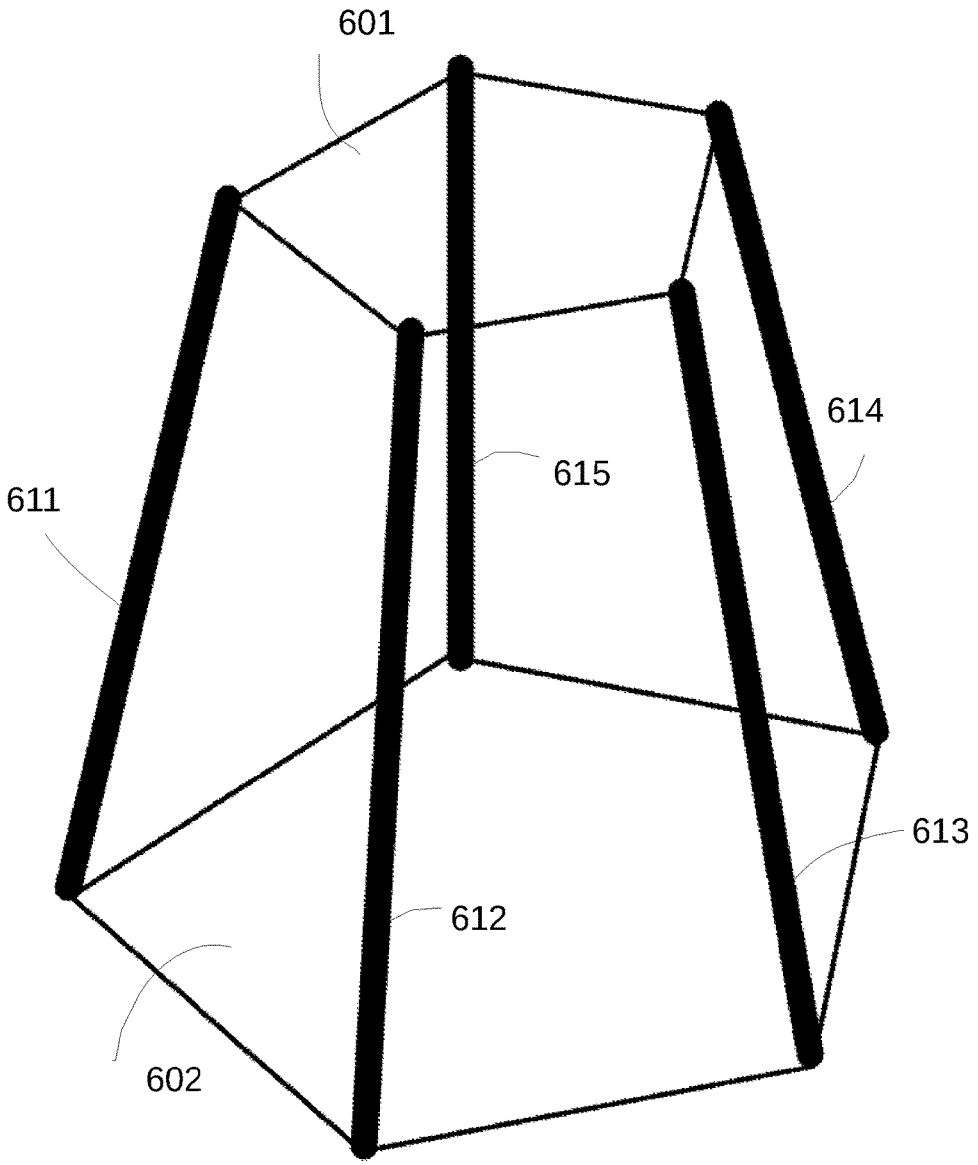
FIG. 5 illustrates an embodiment of a light bar configuration.
Figure 6:
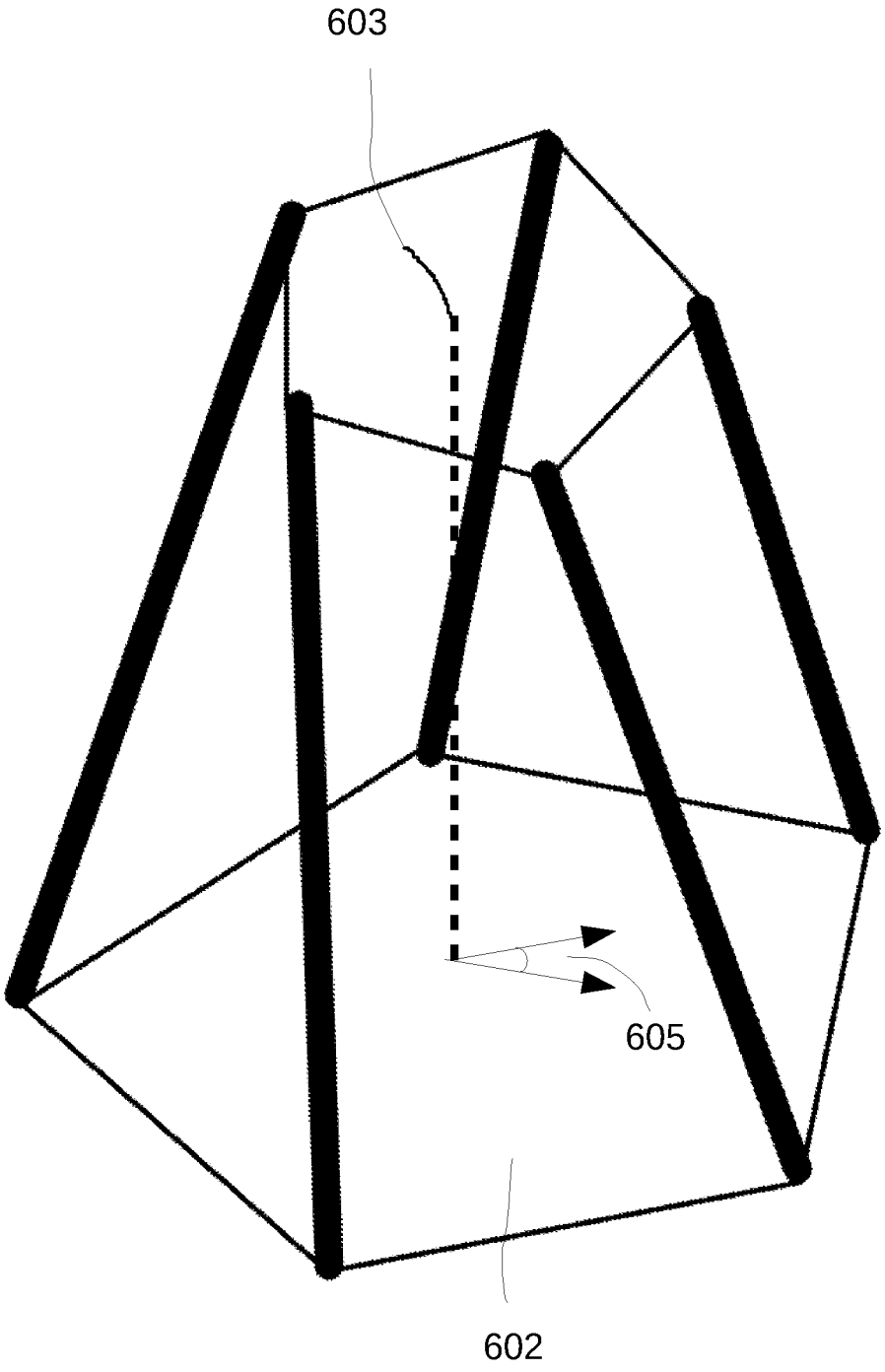
FIG. 6 illustrates an embodiment of a light bar configuration.

Please refer to FIG. 5 and FIG. 6, illustrate the relative relationship between the top polygon formed by one end of the light bar and the bottom polygon formed by the other end of the light bar. According to an embodiment, one end of the plurality of light bars 611, 612, 613, 614, 615 forms a top polygon 601, and the other end of the plurality of light bars 611, 612, 613, 614, 615 forms a bottom polygon 602, and the area of the top polygon 601 is smaller than the area of the bottom polygon 602. In other words, one end of the plurality of light bars has a relatively small polygon, and the other end of the plurality of light bars has a relatively large polygon, both of that form a substantially polygonal cone with a wide bottom and a narrow top. This setting can offer a relatively desired lighting route.

In addition, according to another embodiment, the shape of the top polygon is substantially similar to the shape of the bottom polygonal but is shifted by a predetermined angle. As described above, these light bars 611, 612, 613, 614, 615 usually have different lighting directions. If these light bars are directly perpendicular to the surface of the bulb shell, it is easy to produce a partial area which is particularly bright and a partial area which is relatively dark, thereby generating light spots. Also, such a problem is particularly noticeable when the bulb shell is not completely transparent, such as the bulb shell is milky white. It has been experimentally found that if the top polygon 601 of the plurality of light bars is shifted from the bottom polygon 602 by an angle 605 along a co-vertical axis 603 of the top polygon 601 and the bottom polygon 602, a more desirable lighting effect can be obtained, for example, avoiding the light spots. In addition, the ideal shifted angle can be greater than 10 degrees, less than 80 degrees.

As described above, for the light spot problem, it is possible to make the regular light spot disappear by adjusting the main lighting direction of the plurality of light bars. Because of the different shape and size of the bulb shell, the length of the light bar and the lighting angle might not the same. Hence, the best shifted angle can be ensured by white painting, and experimentally adjusting the main lighting direction of the plurality of light bars, to reduce the dark zone formed on the shell because of less light.

In another embodiment, the core stem can assist in the electrical connection directly or indirectly. In the application of LED chips, there will be a positive and a negative power input terminal. Thus, the core stem can provide a first electrode contact in this embodiment, such as the positive or negative power input terminal. On the other hand, the plurality of extension pieces may provide a second electrode contact, that is, another power input terminal in a different direction from the core stem. The electric power required for the plurality of light bars to light can be supplied by the core stem and the extension piece, and the associated wiring circuit.

In some embodiments, these light bars can be provided in series/parallel. Of course, the description here, in addition to the first group of light bars, a second set of light bars also be allowed. It is possible to have different designs to meet different requirements. For example, for the light bars with different directions, it can be arranged in different groups with relatively different parameters, to provide different lighting parameters, so that to produce the most effective lighting effects on the entire lighting device.

In addition, if the angle of the light bar can be further homogenized, that is, not only light at a specific angle, and the lighting effect of the entire lighting device would be better, and at the same time, by such setting, the lighting angle of the device will be greatly increased. One approach is setting the light bars with more three-dimensional way. As described in the previously embodiments, the bottom cross-section of the translucent cover needs often to match with the size of the lamp cap. On the other hand, if the light bar module need be placed in the translucent cover, as it is often limited by the bottom cross-section of the translucent cover, so it is not easy to put it into the transparent cover.

Thus, in one embodiment, some elastic elements can be added to the extension piece of the base portion, such as a shrapnel or spring, to make a certain compression to the bottom of the light bar module when placing the light bar module and base portion together into the bulb shell from the bottom of the bulb shell, after it is placed, and then expand the bottom of the light bar module.

With this design, the polygonal area at the bottom of the light bar module can be larger than the inlet area of the lamp cap. And, this design can make the lighting angle of the entire light bar module more three-dimensional, but also can bring better lighting effect.

In addition, even with the same number of LED chips, a relatively longer light bar can further uniform the light. In one embodiment, the height of the plurality of light bars in the direction of the lamp cap axis accounts for more than 50% of the height of the light bulb shell in the same direction, so that a better lighting effect can be produced.

In addition, dark areas often appear at the top of the lighting device such as bulbs. In order to solve such a problem, it is possible to place a denser LED chips in a region that the light bar near the top of the translucent cover, i.e., the light bar away from the bottom of the light translucent cover. Alternatively, one or more light sources may be installed on the expansion portion. For example, the expansion portion can be made into a module in which a substrate with LED chips and an optical element are provided, the optical element can handle light more uniform, such as a diffuser plate. By mounting a light source on the expansion portion, the lighting strength toward the top of the light bulb shell can be enhanced.

In addition, in some embodiments, it is also possible to further provide a reflective surface corresponding to the plurality of light bars on the core stem, to reflect the light from the plurality of light bars to the core stem. In the design of the lighting device, guiding the light to the desired area, it is not only useful for improving the optical effect, but also useful for avoiding unnecessary hot spots concentration, which would easily result in components aging.

As mentioned above, the light bar module is mainly located above the base portion. In order to supply power, the driving piece under the base portion also needs to generate the required current. For the convenience of assembly, two electrical connecting wires may be led from the bottom of the base portion, and on the other hand, two corresponding electrical connectors may be provided at the top of the driving piece, such as the driving circuit board. When assembling, the two electrical connecting wires can be inserted into the two electrical connectors, eliminating time and cost of soldering. In another embodiment, the base portion may be provided with a protruding electrical connector, and the driving piece may be provided with an interface, or another different design.

In addition, in order to provide heat dissipation, it is also possible to provide a heat sink with various shapes connected with the core stem on the base portion. These heat sinks can be further connected to other heat sinks, such as the heat sinks inside the driving piece or lamp cap, or connected to the bulb shell to enhance the heat dissipation effect. All of which should to be considered as falling within the scope of the present invention.

Figure 7:
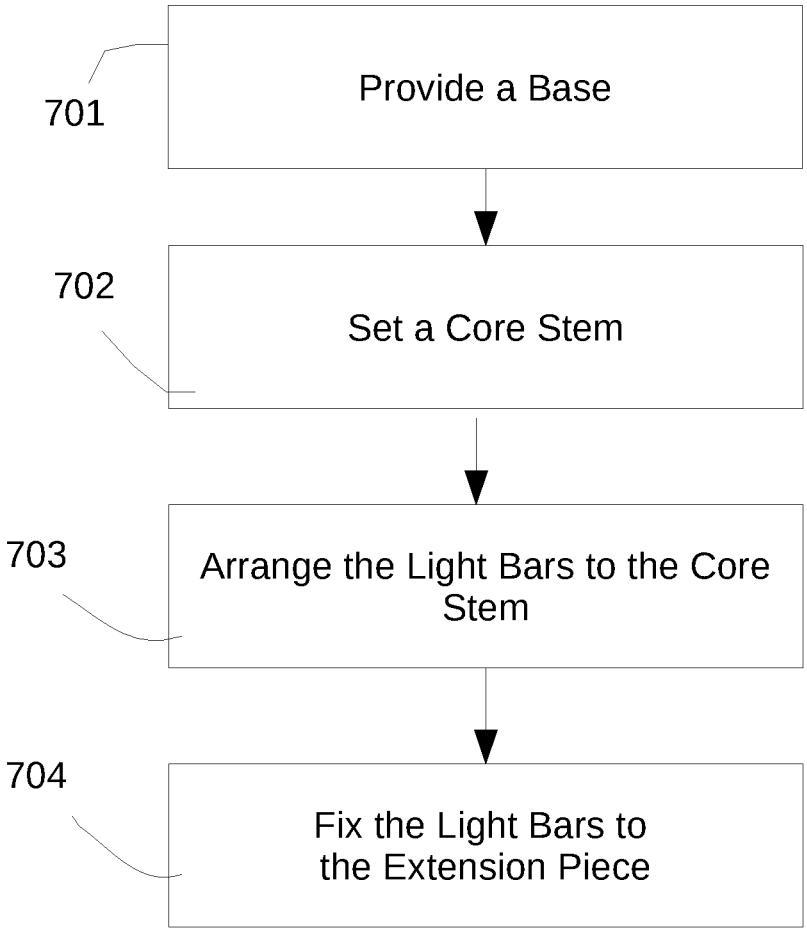
FIG. 7 illustrates a flow chart of a method of assembling a lighting device.

Please refer to FIG. 7. The other embodiment of the present invention provides a method of fabricating a lighting device. The method includes the following steps.

First, provide a base portion (step 701). For example, shape materials with the mold, the materials could be glass or plastic materials, etc.

Set a core stem on the base portion, and provide the expansion portion on the top of the core stem. Both of the core stem and the base portion can be made of glass. Or they are made of different materials, such as the core stem is made of metal rod, metal strip, an iron-nickel wire, and the like, while the base portion is made of glass.

Set the plurality of light bars to the core stem (step 702), wherein an electrical connector of one end of the plurality of light bars is fixed to the expansion portion. In other words, more than two one end of the light bars are connected to the expansion portion. However, this does not mean that a lighting device can only have a group of light bars. In other words, it is not necessary that all the light bars must have one end connected to the expansion portion.

Provide a plurality of extension pieces on the other end of the plurality of light bars (step 703), the extension pieces extending outwardly from the base portion. These extension pieces may be metal rods, metal strips, iron-nickel wire and other materials. These extension pieces may be embedded in the base portion with a variety of different processes. Of course, the base portion mentioned here also includes the bottom of the core stem.

Fix the plurality of extension pieces to the electrical connectors of the other end of the plurality of light bars, respectively (step 704). One of the simplest connections is that the first electrical connector at one end of all the light bars is connected to the positive terminal and the second electrical connector at the other end of all the light bars is connected to the negative terminal. In other words, all light bars are supplied in parallel. Of course, the present invention is not limited to this type of connection, but may be the other electrical connections.

Install the bulb shell to make the bottom of the bulb shell connect to the base portion. The bottom of the bulb shell and the base portion form a containing space. The inert gas is filled in the containing space through the air inlet of the base portion. And after completion of the inflation, the air inlet may be sintered to form a closed containing space so that the inert gas remained in the containing space.

Figure 8:
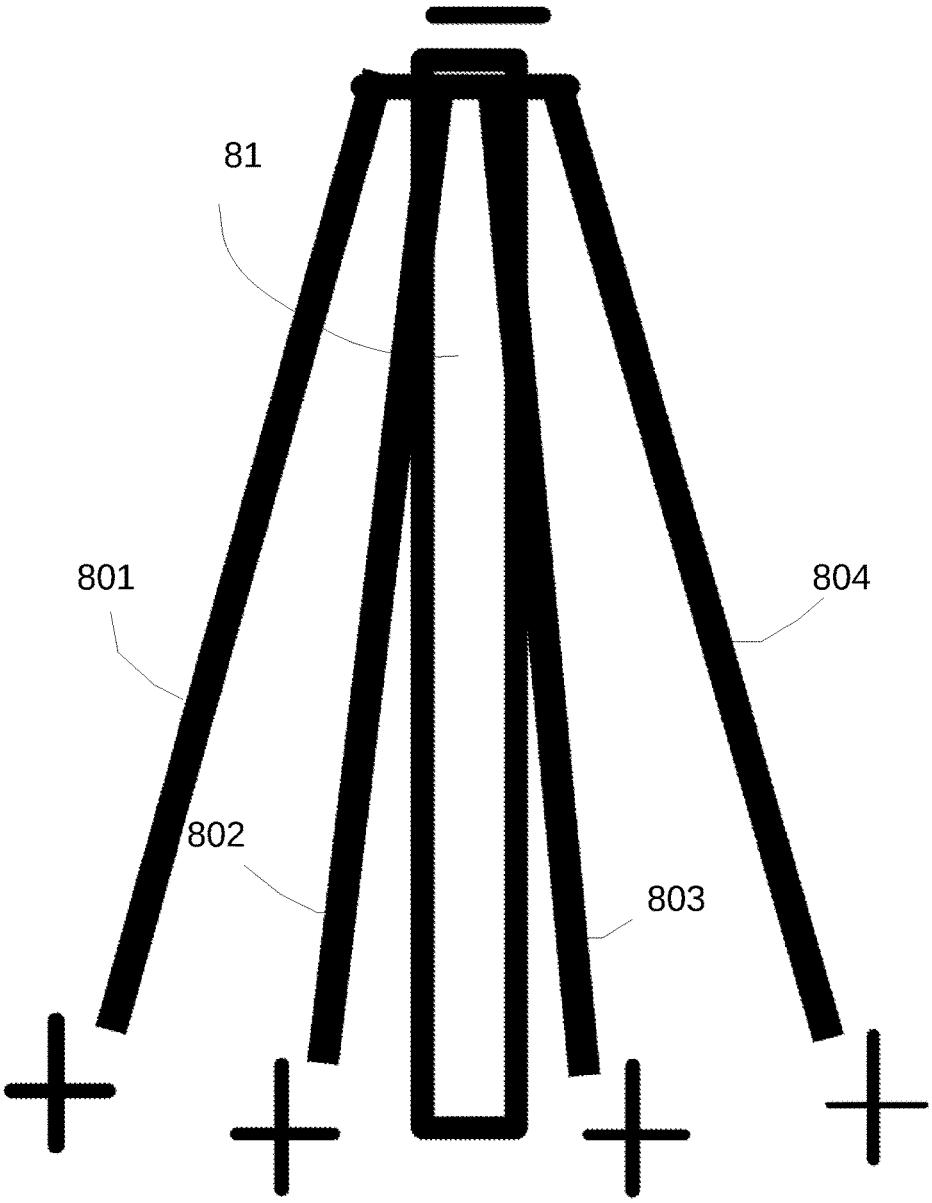
FIG. 8 illustrates a schematic diagram of the electrical connection and fixation of a light bar.
Figure 9:
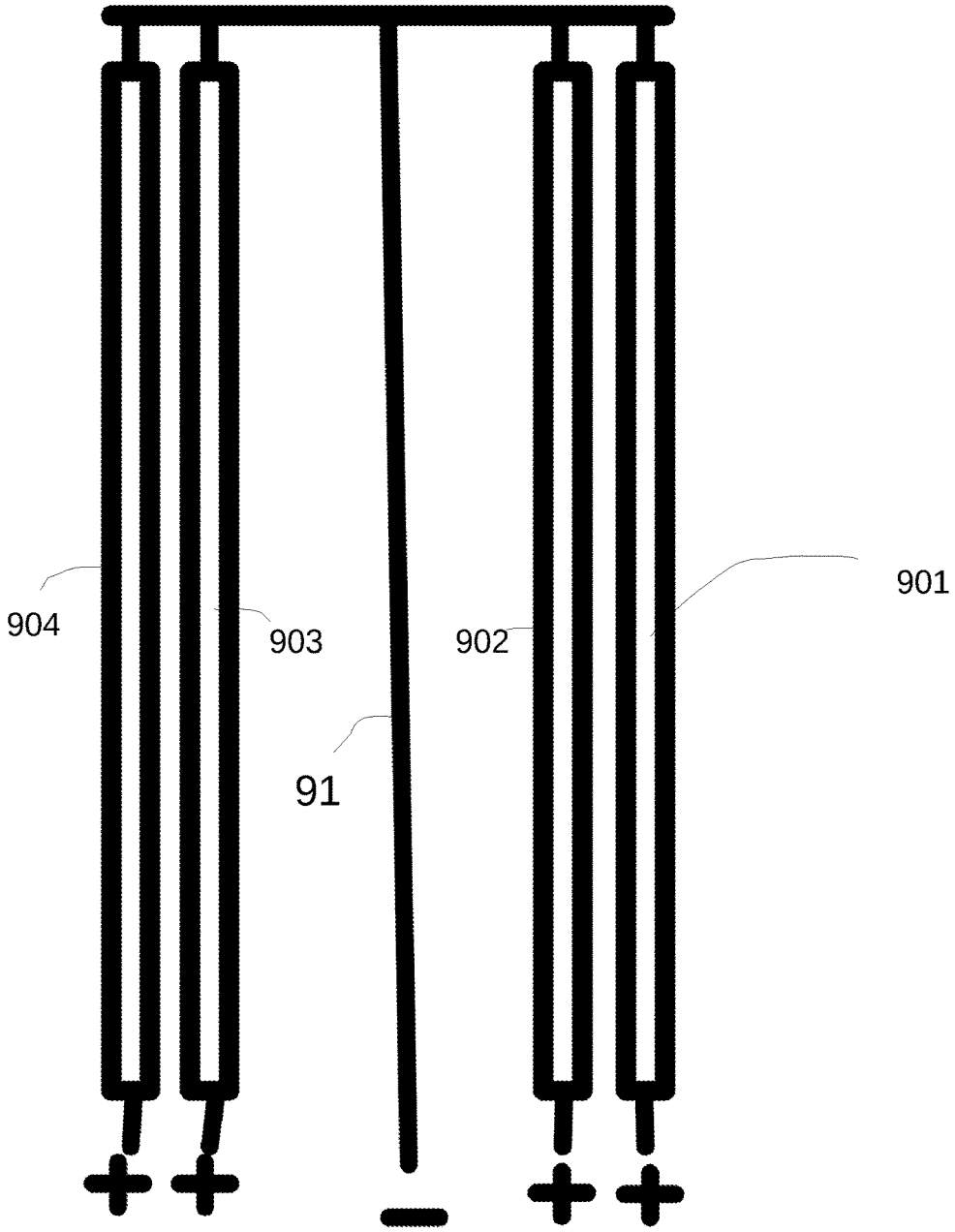
FIG. 9 illustrates a schematic diagram of an electrical connection between light bars.
Figure 10:
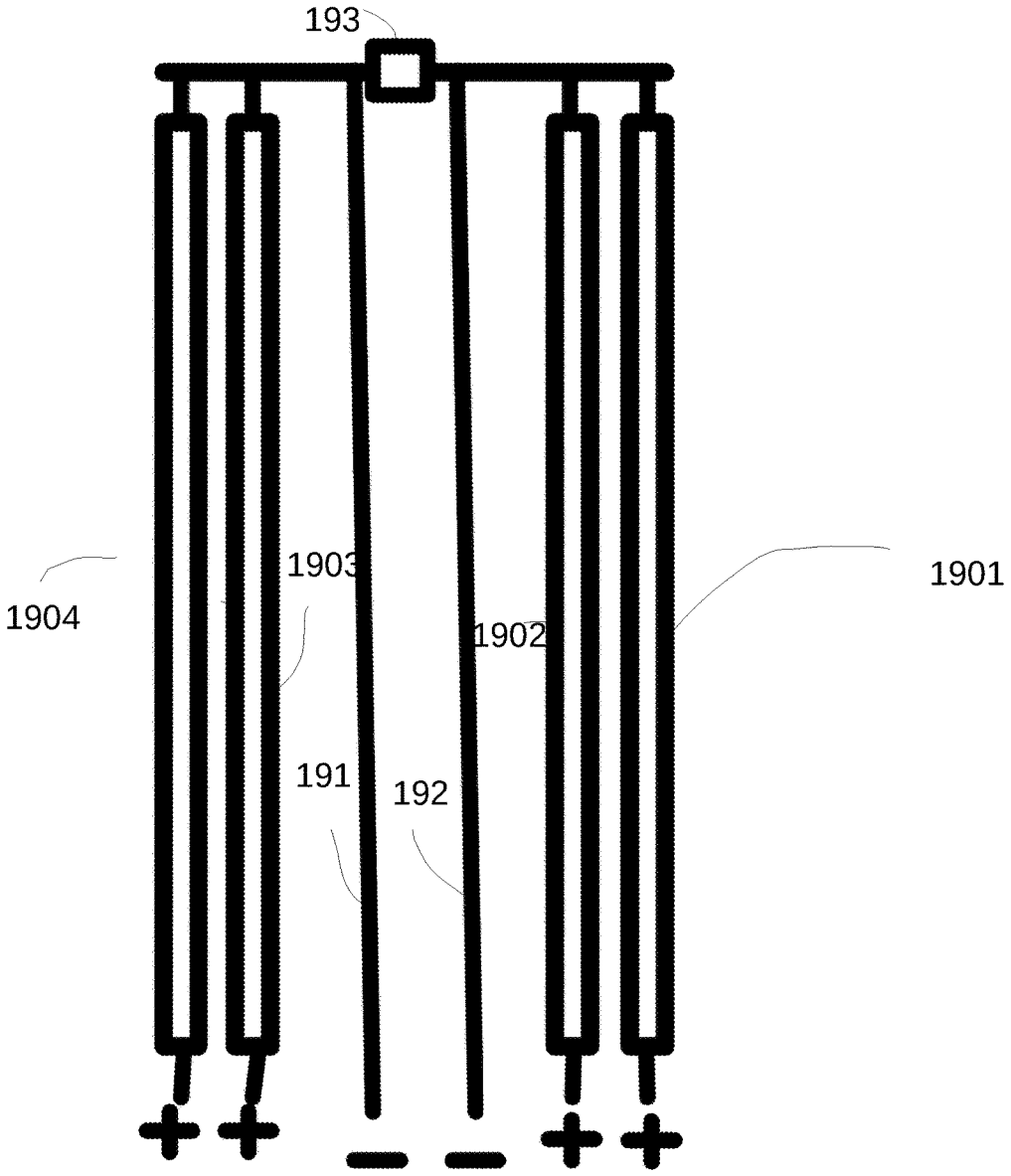
FIG. 10 illustrates another schematic diagram of an electrical connection between light bars.
Figure 11:
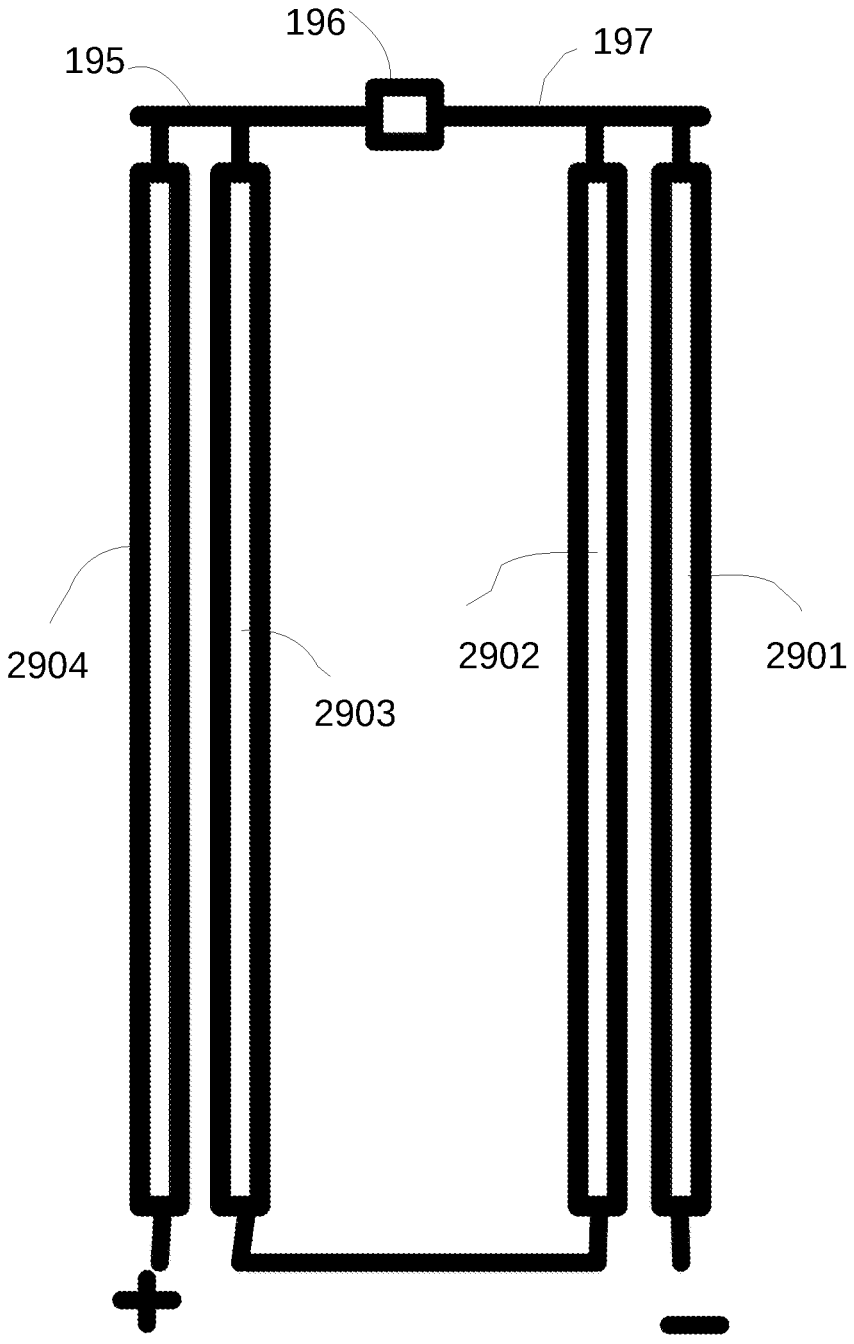
FIG. 11 illustrates another schematic diagram of an electrical connection between light bars.

Please further refer to FIG. 8 to FIG. 11. FIG. 8 illustrates a schematic diagram of the electrical connection and fixation of a light bar. FIG. 9 illustrates a schematic diagram of an electrical connection between light bars. FIG. 10 illustrates another schematic diagram of an electrical connection between light bars. FIG. 11 illustrates another schematic diagram of an electrical connection between light bars.

First of all, in FIG. 8, the tops of the light bars 801, 802, 803, 804 are fixed to the bottom of the core stem 81. In this example, the electrical connections at one ends of these light bars 801, 802, 803, 804 are electrically connected through the metal parts of the chip. Thus, the core stem can further electrically connect to the driver circuit of the lamp cap through the metal portion of the core stem itself or an additional metal wire.

FIG. 9 is a logical diagram. In FIG. 9, the core stem 91 is used to connect the wires or guides (not shown) of drive circuit of the lamp cap, and is electrically connected to one end of the light bars 901, 902, 903 and 904, and then electrically connected to the power supply to form an electrical circuit.

FIG. 10 is another electrical connection and fixation way. One end of the light bars 1901, 1902, 1903 and 1904 is fixed to the top of the core stem. However, unlike FIG. 9, in FIG. 10, the light bars 1901, 1902 become a group, and the light bars 1903, 1904 become another group. The insulating material 193 is provided on the place where the core stem fixedly connected, so that both groups of light bars are fixed to the core stem but are not directly connected to each other. The core stem is electrically connected to the other electrical connector of the drive circuit by two wires 191, 192, respectively, to form an electrical circuit.

FIG. 11 is another electrical connection and fixation way. In this example, the core may be all metal or most are non-metal. At the top of the core stem there are two or more metal portions 195, 197 connected by means of an insulating material 196 for electrically connecting the first group of light bars 2901, 2902 and the second group of light bars 2903, 2904, respectively. And the light bar 2902 is electrically connected to the lamp bar 2903 at the bottom. In other words, this connection is in series.

The above example illustrates four light bars, but it can be expanded to other numbers of light bars, other connection types like parallel, series, etc. These different settings should all be considered falling within the scope of the present invention.

In addition to the above-described embodiments, various modifications may be made, and as long as it is within the spirit of the same invention, the various designs that can be made by a person skilled in the art are susceptible to the present invention range.

The invention claimed is:

1. A lighting device, comprising:

a bulb shell;

a base portion, connecting to the bottom of the bulb shell and forming a cavity with the bulb shell, having a closed air inlet;

an inert gas, entering the cavity from the air inlet and maintained within the cavity after the air inlet is closed;

a light bar module, placed in the cavity, the light bar module composed of a plurality of light bars, each light bar housing a plurality of LED chips, and there being an electrical connector at the two ends of each light bar, respectively;

a core stem, extending upwardly from the base portion, and providing with an expansion portion at the top of the core stem, the electrical connector of one end of the plurality of light bars is fixed to the expansion portion;

a lamp cap, the open end of the lamp camp connecting to the base portion; and a driving piece, placed in the lamp cap and electrically connected to the light bar module to provide electric power required for the plurality of light bars to illuminate, wherein one ends of the plurality of light bars form a top polygon, the other ends of the plurality of light bars form a bottom polygon, the main lighting directions of the plurality of light bars are adjusted by arranging the top polygon of the plurality of light bars being shifted from the bottom polygon by an angle along a co-vertical axis of the top polygon and the bottom polygon for preventing dark zone on the shell.

2. The lighting device of claim 1, wherein the core stem comprises a metal portion, the expansion portion is formed by bending the top of the core stem and constitutes a peripheral structure with a horizontally unfolded distance larger than the diameter of the core stem.

3. The lighting device of claim 2, wherein the electrical connectors of the plurality of light bars are connected to the metal portion of the expansion portion to achieve an electrical connection between the plurality of light bars.

4. The lighting device of claim 2, wherein the core stem is a metal strip, and bending the top of that to form a horizontal circular structure or a horizontal polygon structure as the expansion portion.

5. The lighting device of claim 2, wherein the base portion is made of glass, and the core stem is embedded in the base portion by the tight coupling between the base portion and the core stem to transmit the light emitted by the plurality of light bars to the base portion effectively to be further transmitted to the bulb shell.

6. The lighting device of claim 1, further comprising a plurality of extension pieces, extending outwardly from the base portion and the electrical connectors of the other ends of the plurality of light bars are electrically connected to the extension pieces, respectively.

7. The lighting device of claim 6, wherein the area of the top polygon is smaller than the area of the bottom polygon.

8. The lighting device of claim 7, wherein the top polygon is substantially similar in shape to the bottom polygon and are substantially parallel to each other, and shifted from each other by a predetermined angle in the direction of the top polygon is projected towards the bottom polygon.

9. The lighting device of claim 6, wherein the core stem provides a first electrode contact, the plurality of extension pieces provide a second electrode contact to supply the electric power required for the plurality of light bars to light.

10. The lighting device of claim 6, wherein the plurality of light bars are formed in series or in parallel.

11. The lighting device of claim 6, wherein the extension pieces are flexible, and the area of the polygonal formed by the other end of the plurality of light bars is larger than the area of the open end of the lamp cap.

12. The lighting device of claim 1, wherein the height of the plurality of light bars in the direction of the lamp cap axis accounts for more than 50% of the height of the light Bulb shell in the same direction.

13. The lighting device of claim 1, wherein the base portion provides with two electrical connecting wires, the driving piece further comprises two electrical connectors, the two electrical connecting wires are inserted into the two electrical connectors, and then connected to the plurality of light bars to supply the electric power required for the plurality of light bars to light.

* * * * *